United States Patent [19]

Frye

[11] 4,038,500

[45] July 26, 1977

[54] MICROPHONE COUPLER

[76] Inventor: George J. Frye, 12175 SW. Douglas, Portland, Oreg. 97225

[21] Appl. No.: 588,885

[22] Filed: June 20, 1975

[51] Int. Cl.[2] ..... H04R 29/00

[52] U.S. Cl. ..... 179/175.1 A; 179/1 C

[58] Field of Search ..... 179/175.1 A, 1 C, 2 C, 179/6 AC

[56] References Cited

U.S. PATENT DOCUMENTS

| | | | |
|---|---|---|---|
| 3,619,507 | 11/1971 | Metz | 179/1 C |
| 3,719,783 | 3/1973 | Kennedy | 179/1 C |
| 3,725,584 | 4/1973 | Kilmer et al. | 179/1 C |

OTHER PUBLICATIONS

"Comparable Coupler and Real-Ear Measurements on Supraaural and Insert-Type Earphones" by Bryant, in *Journal of the Acoustical Society of America,* vol. 52, No. 6 (part 2) 1972, pp. 1599-1606.

American National Standard Method for Coupler Calibration of Earphones, 53.7-1973.

*Primary Examiner*—Douglas W. Olms

*Attorney, Agent, or Firm*—Adrian J. LaRue

[57] ABSTRACT

A microphone coupler for use in performing frequency response tests on earphones of a type normally used for testing the range and condition of human hearing in which a microphone is sealingly carried. The microphone coupler is adapted to rest in position on the earphone under test and is coupled thereto with the proper force by virtue of its own weight, and it includes lip means for guiding the microphone coupler into concentric engagement between a cushion-engaging surface and an earphone to be tested with the lip means also protecting the cushion-engaging surface.

3 Claims, 2 Drawing Figures

MICROPHONE COUPLER

BACKGROUND OF THE INVENTION

The conventional practice for testing audiometer earphones has been to place the earphone into position on top of a vertically oriented coupler and then to force the earphone into engagement with the coupler mating surface by means of a spring mechanism which provides a specified pressure in order to obtain proper testing.

A major drawback of this practice has been the unrealiability of the spring mechanism used to provide the specified pressure because of its complicated structure and susceptibility of being readily damaged.

SUMMARY OF THE INVENTION

The present invention relates to microphone couplers mand more particularly to microphone couplers for testing earphone for audiometers.

An object of the present invention is to provide a microphone coupler which eliminates the use of any spring mechanism to obtain necessary coupling pressure between the microphone coupler and the earphone.

Another object of the present invention is the provision of a microphone coupler which is adapted to rest on the earphone under test.

A further object of the present invention is to provide a microphone coupler with the necessary weight to provide the required coupling pressure therebetween.

An additional object of the present invention is the provision of a microphone coupler which has lip means for guiding the coupler into correct alignment with the earphone thereby centering each with respect to the other.

A still further object of the present invention is to provide a microphone coupler which has a specified coupling cavity, an earphone mating surface and lip means to provide mechanical protection thereto.

These and other objects of the present invention will appear more fully from the following description and the accompanying preferred embodiment of the invention. It is to be understood that changes may be made from the exact details shown and described without departing from the principles of the invention.

DETAILED DESCRIPTION OF THE INVENTION

Figure 1:
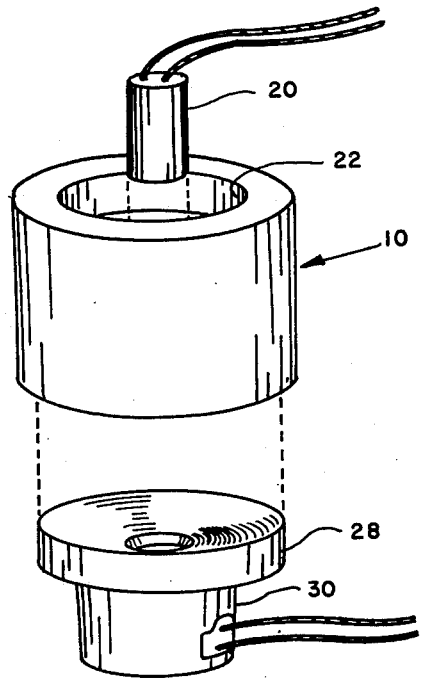
FIG. 1 is an exploded perspective view of the microphone coupler and an earphone to be tested.
Figure 2:
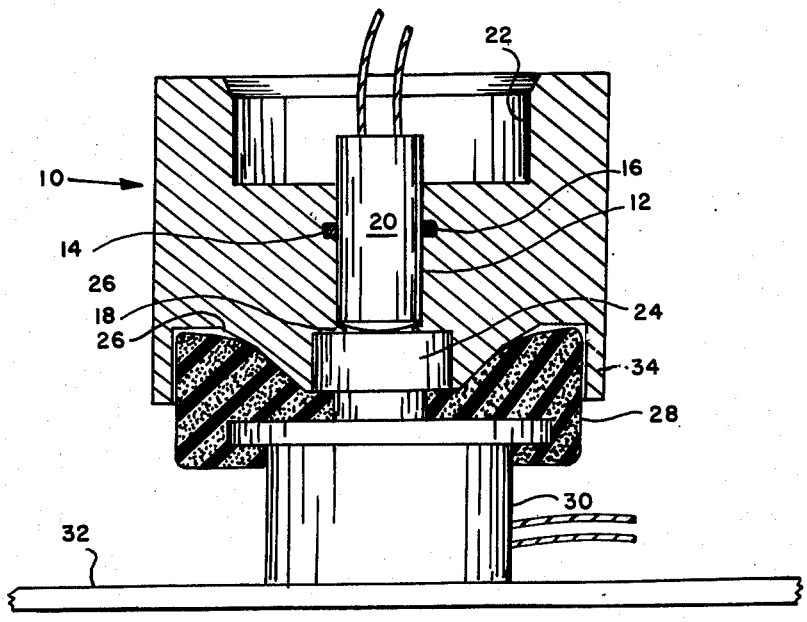
FIG. 2 is a cross-sectional view of the microphone coupler which is in operating position on the earphone.

Turning now to the drawing, a microphone coupler 10 is a member of preferably annular configuration and is preferably made of a suitable metal and is provided with a microphone bore 12 having an annular groove 14 in which a rubber O-ring 16 is positioned. An annular lip 18 is provided at the inner end of bore 12 and defines a stop to limit the inner movement of a measuring microphone 20 sealingly positioned within microphone bore 12. An access opening 22 concentric with microphone bore 12 permits insertion and removal of the microphone 20. Microphone bore 12 communicates with a coupling cavity 24 which has a specified volume.

Concentric with coupling cavity 24 is a specified engaging surface 26 for engaging a cushion 28 of an earphone 30 which is disposed on supporting surface 32. Annular lip means 34 surrounds engaging surface 26 to guide microphone coupler 10 into concentric alignment with earphone 30 and also provides mechanical protection for engaging surface 26 when not in use because lip means 34 extends outwardly further than the inner end of engaging surface 26.

Microphone coupler 10 has the necessary weight to provide the required coupling pressure between the specified engaging surface 26 and cushion 28 of earphone 30.

It can readily be discerned that a unique microphone coupler has been disclosed which is readily capable of providing the required coupling pressure between the coupler and an earphone due to its weight and which is provided with a guiding and protective lip menas for guiding the coupler and earphone into concentric relationship and to protect the cushion engaging surface of the coupler.

Although the invention has been explained with reference to a particular embodiment, it is to be appreciated that various adaptations and modifications may be made without departing from the appended claims.

The invention is claimed in accordance with the following:

1. An earphone testing system,comprising:

a rigid supporting member, an earphone to be tested positioned on said supporting member with its acoustic output end facing upwardly, a raltively heavy body member provided with a bore therethrough terminating in a cavity of predeterminded volume at one end and forming an acoustic coupler, a microphone fitted closely within the bore, said coupler having an annular lip extending axially from said one end, a cushioning member within the space provided by said lip having an opening therethrough in communciation with said cavity therein and seated against said one end, said body member being seated on said one end of the earphone through the interposition of said cushioning member, the acoustic output of the earphone being in direct communication with the cavity in the body member through the opening in the cushion member, the body member being of sufficient weight to compress the cushioning member against the earphone to provide the necessary coupling pressure to prevent acoustic leakage between the earphone output and the microphone.

2. An earphone testing system according to claim 1 wherein said body member has an annular configuration.

3. An earphone testing system according to claim 1 wherein stop means are provided at the inner end of said bore to limit inner movement of the microphone in said bore.

* * * * *